US008091629B2

(12) United States Patent
Fogg et al.

(10) Patent No.: US 8,091,629 B2
(45) Date of Patent: Jan. 10, 2012

(54) ADJUSTABLE WIRELINE SHEAVE FOR STUFFING BOX

(75) Inventors: James Fogg, Great Yarmouth (GB); Jeremy Ward, Great Yarmouth (GB)

(73) Assignee: Weatherford/Lamb, Inc., Houston, TX (US)

( * ) Notice: Subject to any disclaimer, the term of this patent is extended or adjusted under 35 U.S.C. 154(b) by 79 days.

(21) Appl. No.: 12/485,195

(22) Filed: Jun. 16, 2009

(65) Prior Publication Data

US 2010/0314099 A1 Dec. 16, 2010

(51) Int. Cl.
*E21B 19/22* (2006.01)

(52) U.S. Cl. ..... 166/77.1; 166/385; 254/390; 254/398

(58) Field of Classification Search ..... 166/77.1; 254/398, 390, 393
See application file for complete search history.

(56) References Cited

U.S. PATENT DOCUMENTS

| | | | | |
|---|---|---|---|---|
| 447,199 | A * | 2/1891 | Paul | 254/390 |
| 2,283,048 | A | 6/1940 | Collett | |
| 3,104,094 | A | 9/1963 | Liem et al. | |
| 3,171,633 | A | 3/1965 | Le Bus, Jr. et al. | |
| 3,292,908 | A | 12/1966 | Thompson | |
| 3,385,563 | A | 5/1968 | Stinson | |
| 3,831,676 | A | 8/1974 | Brown et al. | |
| 4,301,995 | A | 11/1981 | Niskin | |
| 4,469,171 | A | 9/1984 | Mine | |
| 4,480,818 | A | 11/1984 | Frank | |
| 4,610,645 | A | 9/1986 | Donn et al. | |
| 5,078,656 | A * | 1/1992 | Brandenstein et al. | 474/112 |
| 5,645,269 | A | 7/1997 | Peterson | |
| 5,752,892 | A * | 5/1998 | Taomo et al. | 474/112 |
| 6,105,939 | A | 8/2000 | Vance et al. | |
| 6,386,516 | B1 | 5/2002 | Lenders | |
| 6,481,695 | B1 | 11/2002 | Fuller | |
| 6,536,743 | B2 * | 3/2003 | Selcer et al. | 254/333 |
| 6,699,149 | B1 * | 3/2004 | White et al. | 474/133 |

(Continued)

FOREIGN PATENT DOCUMENTS

GB 2418463 A 3/2006

(Continued)

OTHER PUBLICATIONS

Western Pressure Controls 2005 Ltd., "WPC Wellhead Sheave (Hay Pulley)," Product Specifications, undated.

(Continued)

*Primary Examiner* — David Bagnell
*Assistant Examiner* — Kipp Wallace
(74) *Attorney, Agent, or Firm* — Wong Cabello Lutsch Rutherford & Brucculeri, LLP

(57) ABSTRACT

A stuffing box assembly for a wellhead intervention has a stuffing box and an adjustable sheave. The stuffing box has a body with a collar for connecting to a wellhead and with a passage for running wireline therethrough. A frame connected to the body has side plates and has a hub assembly with hubs rotatable about a first rotational axis. An axle interconnects the two hubs and supports them between the side plates. The sheave can rotate about the second rotational axis of the axel to run the wireline into and out of the stuffing box. The hub assembly can be rotated about its axis of rotation to adjust the location of the axle's axis of rotation. This can move the sheave away from a fixed guard, can change how the sheave lines up with the stuffing box, and can move the sheave away from the stuffing box.

33 Claims, 6 Drawing Sheets

U.S. PATENT DOCUMENTS

| | | | | |
|---|---|---|---|---|
| 7,419,138 | B1 | 9/2008 | Mauthner | |
| 7,431,269 | B2 * | 10/2008 | Carlson et al. | 254/405 |
| 7,438,281 | B2 * | 10/2008 | Pesnel | 254/393 |
| 2002/0158505 | A1 * | 10/2002 | Lund | 301/110.5 |
| 2004/0009837 | A1 | 1/2004 | Serkh et al. | |
| 2008/0203371 | A1 | 8/2008 | Mauthner | |

FOREIGN PATENT DOCUMENTS

| | | | |
|---|---|---|---|
| GB | 2433283 | A | 6/2007 |
| WO | 2006/030186 | A1 | 3/2006 |

OTHER PUBLICATIONS

Cromar, "Slickline Hay Pulleys & Line Wipers," Product Brochure, undated.

Petro Oil Tools, LLC "7 "(0.92") Hay Pulley/Wireline Sheave," obtained from http://www.petrooiltools.com, copyright 2005.

"Hay Pulley for 5/16" Wire," obtained from http://www.dreieservice.no, dated Aug. 19, 2006.

"Hay Pulley for SL og 7/32" Wire," obtained from http://www.dreieservice.no, dated May 26, 2006.

Western Pressure Controls Ltd., "Wellhead Sheave (Hay Pulley)," obtained from http://www.westernpressure.com, copyright 2008.

Rigtrain, Pressure Control Equipment: Fig. 13—Wireline Stuffing Box (Hydraulic), p. 27, copyright 2002.

Notice of Allowance in co-pending U.S. Appl. No. 12/485,154, mailed Sep. 19, 2011.

* cited by examiner

ADJUSTABLE WIRELINE SHEAVE FOR STUFFING BOX

CROSS-REFERENCE TO RELATED APPLICATIONS

This application is filed concurrently with U.S. patent application Ser. No. 12/485,154, entitled "Adjustable Wireline Sheave for Hay Pulley," which is incorporated herein by reference in its entirety.

BACKGROUND

Sheaves are used to route a wireline from a reel to a stuffing box at a wellhead. One such sheave mounts onto the stuffing box and has a peripheral groove in which the wireline runs. Conventionally, the sheave's diameter and the depth of its groove are sized so that the center of the wireline will coincide with the centerline through the stuffing box. Therefore, a different sized sheave must be used to accommodate different sized wirelines so the wirelines can properly line up with the centerline of the stuffing box.

FIG. 1 shows one type of sheave assembly 10 according to the prior art for a stuffing box 20. This sheave assembly 10 and stuffing box 20 are manufactured by Weatherford—the Assignee of the present disclosure. The stuffing box 20 fits atop components of a wellhead (not shown), and the sheave assembly 10 attaches to the stuffing box 20 to guide the wireline in and out of the wellhead. The stuffing box 20 has a body 30 with a collar 32 for fitting onto the wellhead. A cartridge insert 36 has glands and packing and positions in the body 30 to pack off the wireline that passes through the stuffing box 20. A packing nut 37 affixes the insert 36 on the body 30, and a hydraulic packing cylinder 34 attaches atop the box 20 and holds a hydraulic packing piston and spring.

As for the sheave assembly 10, side plates 40 connect to a bearing block 38 on the stuffing box's body 30, and a sheave 50 mounted between these plates 40 can rotate about a wheel bearing 52 on an axle 55 disposed between the plates 40. A guard 45 connects by a locking stud 47 to one of the plates 40 so the guard 45 can be removed and adjusted relative to the periphery of the sheave 50.

As best shown in the detail of FIG. 2A, a bush assembly 60 has a bush 70 that fits onto the axle 55 and the side plate 40 on each side of the sheave 50. The bush 70 (shown alone in FIG. 2C) has an opening 75 for the axle 55 and has a shoulder 72 disposed around the bush 70. The sheave 50 can be adjusted using the bush assembly 60 so the assembly 10 can accommodate different sized wirelines. In particular, the bush 70 fits in an upright position in the side plate's opening 42, as indicated by the arrow on the bush 70. The bush's shoulder 72 (FIG. 2C) fits into the side plate's opening 42 (FIG. 2B) so the bush 70 can support the axle 55 in the axle opening 75 (See FIG. 2A).

Depending on how the bush 70 is oriented in the opening 42, a first bush hole 80A on the bush 70 can align with one of two plate holes 61A/62A on the side plate 40. In this way, the screw 90 in first bush hole 80A can fit into the plate hole 61A for 0.187" wire or can fit into the plate hole 62A for 0.125" wire. In addition, a second bush hole 80B on the bush 70 can align with one of three plate holes 61B/62B/63B. Here, the screw 90 in second bush hole 80B can fit into the plate hole 61B for 0.108" wire, can fit into the plate hole 62B for 0.160" wire, or can fit into the plate hole 63B for 0.250" wire. Although effective, adjusting the sheave 50 in this way can be tedious and time consuming.

As with the sheave assembly 10 of FIG. 1 and other conventional sheave assemblies of the prior art, a guard is normally attached above the sheave to prevent the wireline from jumping off of the sheave when being run thereon. When rigging up the wireline, the guard must be moved out of the way by removing studs or screws that hold the guard to the assembly. As expected, this procedure can be tedious and time consuming.

In one prior art solution, the assembly supporting the sheave can be entirely hinged out of the way as disclosed in UK Patent Applications GB 2,418,463 and GB 2,433,283 to give access for rigging up the wireline. When such an assembly is hinged out of the way, a cam action lifts the guard clear of the sheave. Because this hinge forms part of the load path of the assembly supporting the sheave, it must be sized in accordance with the safe working load of the stuffing box, which can be disadvantageous.

The subject matter of the present disclosure is directed to overcoming, or at least reducing the effects of, one or more of the problems set forth above.

SUMMARY

An assembly for wellhead intervention has a stuffing box and an adjustable sheave assembly. The stuffing box mounts on a wellhead and has a passage for running wireline therethrough. The adjustable sheave assembly mounts onto the stuffing box with a frame having two arms. A sheave fits between these two arms and can rotate on an axle. Instead of having the axle mounted directly to the arms of the frame, the axle connects at each end to hubs that are rotatably mounted on both arms.

As the sheave routes wireline to and from the stuffing box, the sheave can rotate about the axle. However, the hubs can be rotated about an eccentric axis of rotation. This rotating of the hubs adjust the location of the axle's axis of rotation relative to the frame and the stuffing box and can be used to move the sheave away from a guard and the stuffing box. For example, one of the arms of the frame can have the guard affixed thereto. When the hubs are rotated, the sheave is moved away from the guard to provide clearance for rigging up the wireline. To make this adjustment, the hubs are rotated on the arms and move the sheave relative to the guard.

Preferably, a lock is used on the hubs to lock them in one of several positions. The lock can uses a spring loaded key attached to one or both of the hubs. To move the sheave, an operator pushes the key toward the center of the hub to disengage the key from a slot in a surrounding housing. Simultaneously, the operator uses handles on the keys to rotate the hubs. As the hubs rotate, the sheave can be moved out of the way of the guard. In addition, rotating the hubs can adjust the alignment of the sheave's peripheral groove with the centerline through the stuffing box. In this way, the same sheave can be used to accommodate difference sized wirelines. Also, the sheave can be moved by rotating the hubs so removable components on the stuffing box, such as a packing cartridge can be accessed for replacement.

Advantageously, the movable keys that can engage and disengage from the lock locations on the housing facilitate the adjustment of the sheave by operators to either move the sheave away from the guard, gain access to the stuffing box, or to adjust what sized wireline the sheave can accommodate. Moreover, the movable keys with handles enable the operators to readily rotate the hubs in the frames and adjust the sheave's axle location. These adjustments can be made without the tedious and time-consuming handling currently required for sheave assemblies.

The foregoing summary is not intended to summarize each potential embodiment or every aspect of the present disclosure.

DETAILED DESCRIPTION

Figures 1, 2A, 2B, 2C:
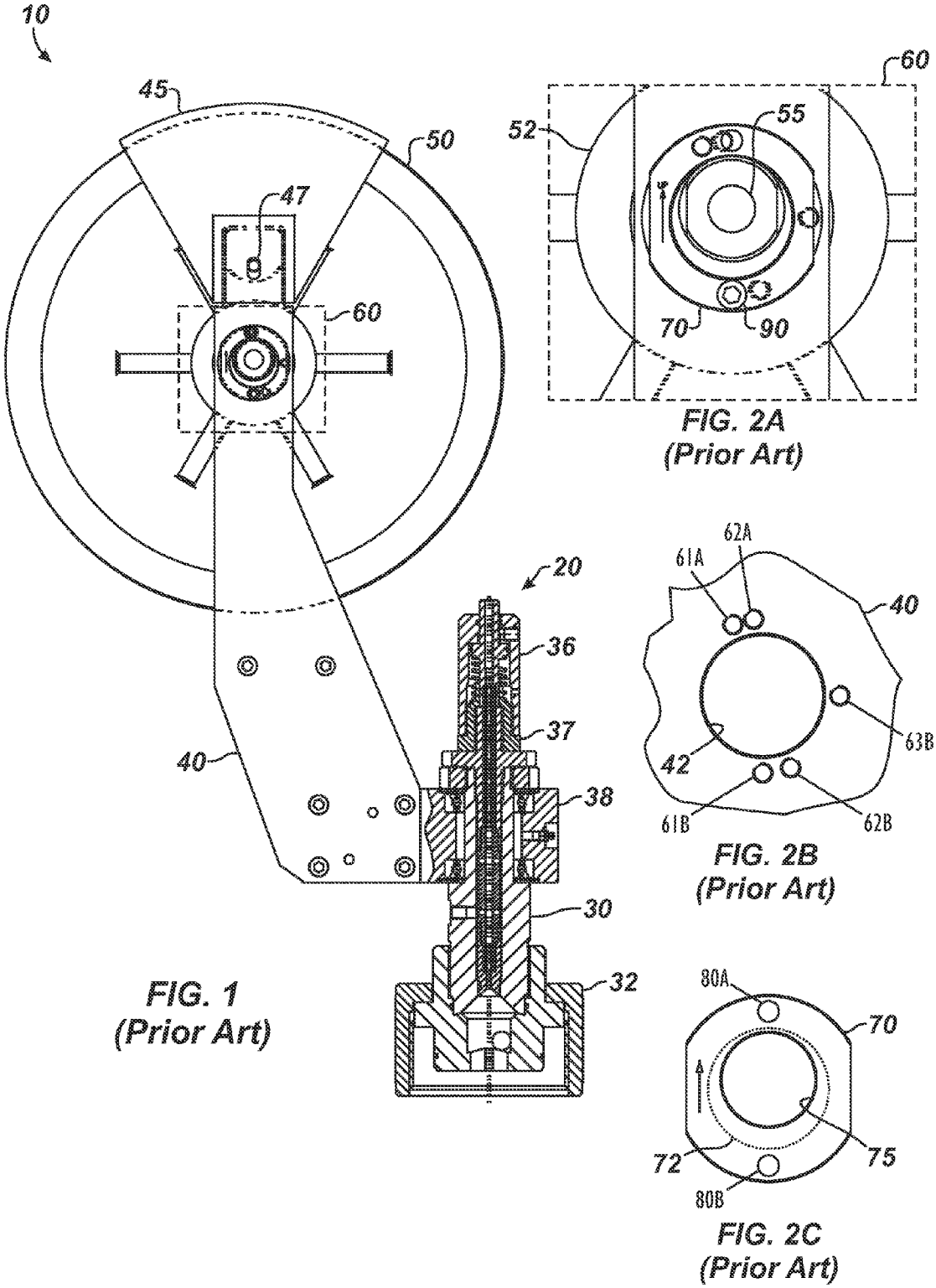
FIG. 1 (Prior Art)
FIG. 2A (Prior Art)
FIG. 2B (Prior Art)
FIG. 2C (Prior Art)
FIG. 1 shows a side view of a stuffing box with a sheave assembly according to the prior art.
FIG. 2A is a detail view of a bush assembly for the sheave assembly of FIG. 1.
FIG. 2B is a detail of the side plate showing position holes for the bush assembly of FIG. 2A.
FIG. 2C is a detail of the bush for the bush assembly of FIG. 2A.
Figure 3A:
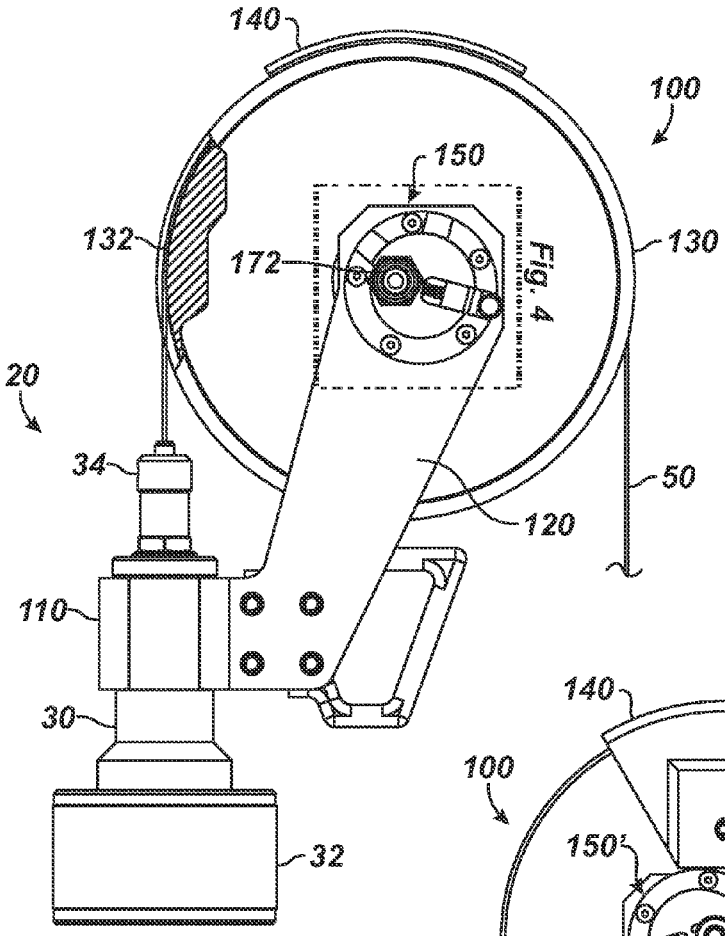
FIGS. 3A-3B shows side views of a stuffing box with a sheave assembly according to the present disclosure.
Figure 3B:
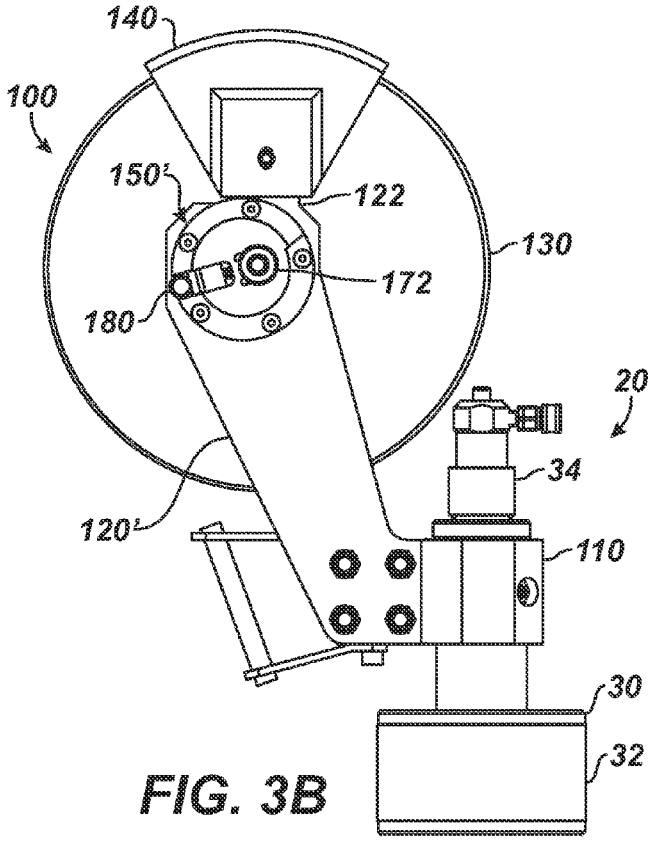

As shown in FIGS. 3A-3B, an adjustable sheave assembly 100 according to the present disclosure is used on a stuffing box 20 to run a wireline 50 to and from a wellhead (not shown) during wireline operations. The stuffing box 20 can be similar to that discussed previously. For example, the body 30 of the stuffing box 20 mounts to the wellhead with a collar 30 and houses an insert (not shown) with glands and seals for packing off the wireline 50. A cartridge 34 at the end of the body 30 passes the wireline 50 therethrough. This cartridge 34 contains a packing chamber for the wireline 50 and is preferably removable from the body 30 for replacement.

The sheave assembly 100 has a frame 110 that mounts onto the stuffing box 20 using a bearing assembly or the like. The frame 110 has forked arms 120-120' that hold the sheave 130 therebetween. As the wireline 50 is routed from conventional wireline equipment (not shown) to the sheave 130, the wireline 50 fits into a peripheral channel 132 around the sheave 130.

As shown in FIG. 3B, a safety guard 140 is affixed to an extended portion 122 of one of the arms 120' and positions at the periphery of the sheave 130. During operations, the guard 140 can prevent the wireline 50 from jumping out of the sheave 130. Guided by the sheave 130, the wireline 50 passes through the centerline of the stuffing box 20 and more particularly into the cartridge 34. As expected, proper alignment of a tangential line from the sheave's periphery to the stuffing box's centerline is important for operation so that the wireline 50 can fed centrally through the stuffing box 20.

Hub assemblies 150-150' disposed on both arms 120-120' support an axle 172 on which the sheave 130 rotates. The hub assemblies 150-150' can be adjusted to move the sheave 130 relative to the arms 120-120' and the guard 140 and can be used to provide clearance when rigging up the wireline 50. As shown in more detail in the side view of FIG. 4 and the cross-section of FIG. 5, the hub assemblies 150-150' each have an outer housing 160 attached to the surface of the arm 120-120' using bolts 161 or the like. The housings 160 hold hubs 170 that can rotate therein. The center shaft 172 passes through these hubs 170 and the sheave 130 from one hub assembly 150 to the other hub assembly 150', and a bolt 174 affixes the center shaft 172 to one of the hubs 170.

Figure 4:
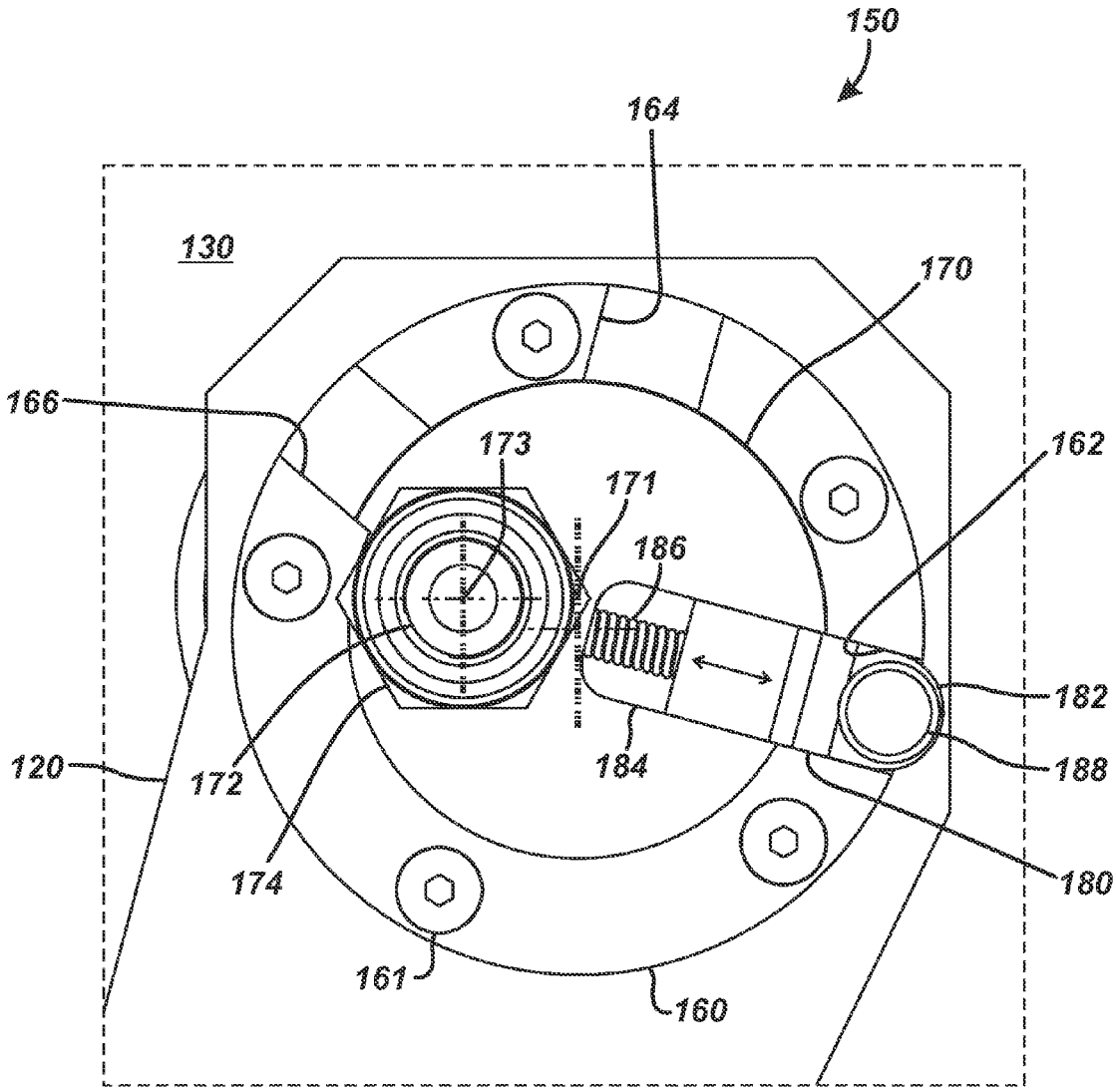
FIG. 4 is a detail view of a hub assembly for the sheave assembly of FIGS. 3A-3B.
Figure 5:
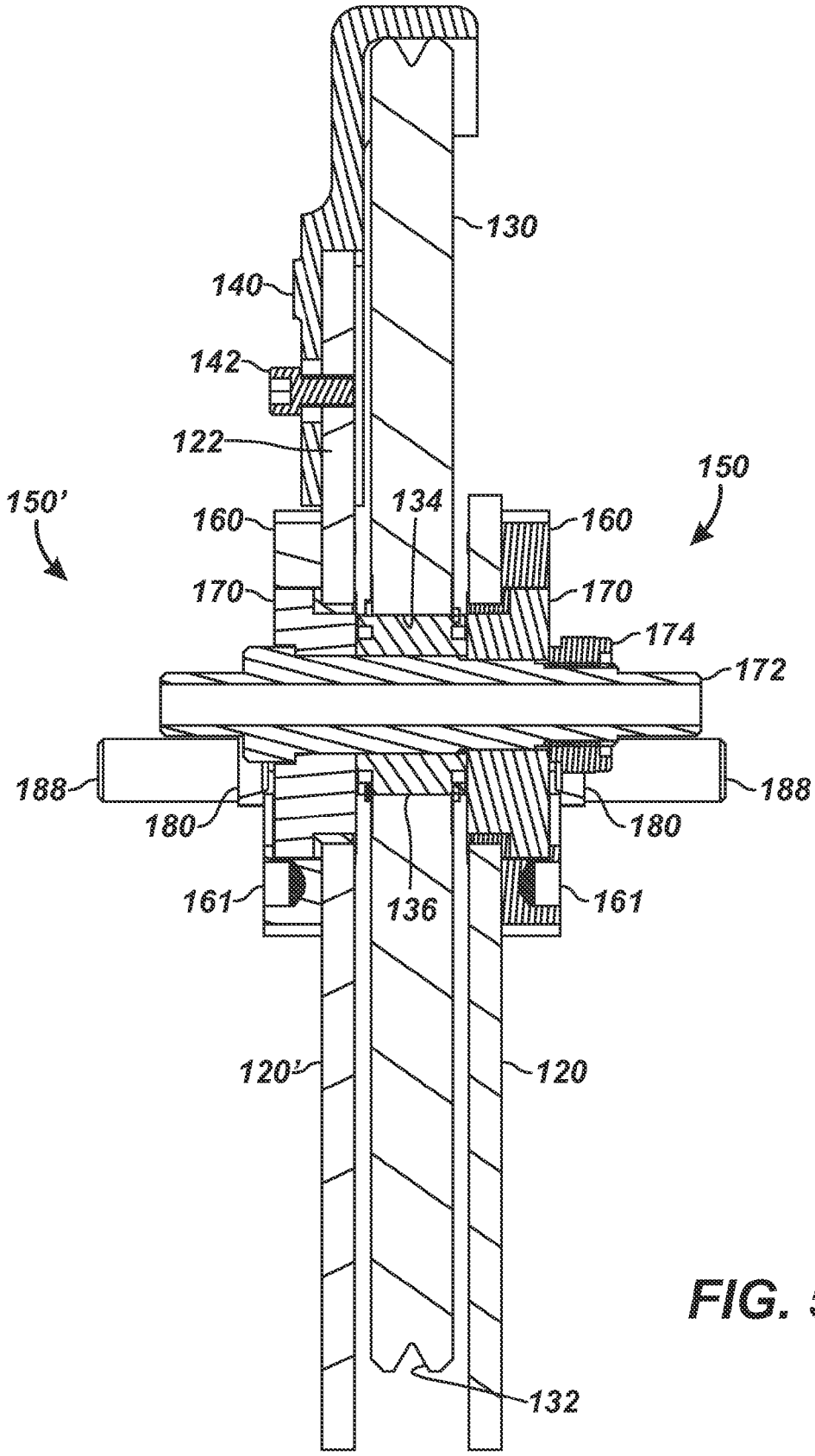
FIG. 5 is a cross-sectional view of the sheave assembly for the stuffing box.

As best shown in FIG. 4, the center axis 173 of the shaft 172 is eccentrically located relative to a center axis 171 of the hubs 170 about which the hubs 170 can rotate in the housings 160. Therefore, rotation of the hubs 170 eccentrically moves the center shaft 172 relative to the arms 120-120' and consequently moves the position of the sheave 130 that rotates on the shaft 172. To rotate the hubs 170, keys 180 are attached to the hubs 170 and have handles 182 for an operator to turn the hubs 170 in the housings 160.

At least one of these keys 180 on a side of the assembly 100 can engage in any one of several slots on the outer housing 160 to lock the hub 170 in one of the rotated positions. As shown in FIG. 4, three such slots 162, 164, and 166 are provided in the housing. In use, an operator uses the handle 188 on the key 180 to push it inward toward the center of the hub 170 against the bias of a spring 186. In an alternative arrangement, the key 180 may be moved outward from the hub 170 so that portion of the key 180 clears the housing 160.

Regardless, the distal end 182 of the key 180 is movable in a direction perpendicular to the axis of rotation for the hub 170 relative to a proximal end 184 of the key 180 attached to the hub 170. Shifting the distal end 182 of the key 180 disengages it from the slot 162 in the outer housing 160 so the operator can rotate the hub 170 in the housing 160 using the key's handle 188. In turn, the rotation of the hub 170 eccentrically shifts the position of the center shaft 172 and the sheave 130 about the hub's center 171 and relative to the frame 110. The key 180 can then be released to engage the distal end 182 in another of the slots 164 or 166 of the housing 160.

Having the key 180 engaged in the first slot 162 shown in FIGS. 3A & 4 positions the sheave 130 in its operating condition. In this condition, a tangential line running from the sheave's channel 132 aligns with the stuffing box's centerline so that the wireline 50 can be properly run into and out of the stuffing box 20. As shown in FIG. 3B, the edge of the sheave 130 also fits adjacent the guard 140 affixed to the frame 110. In this position, the guard 140 can prevent the wireline 50 from jumping out of the peripheral channel 132 of the sheave 132 when running the wireline 50.

Figure 6:
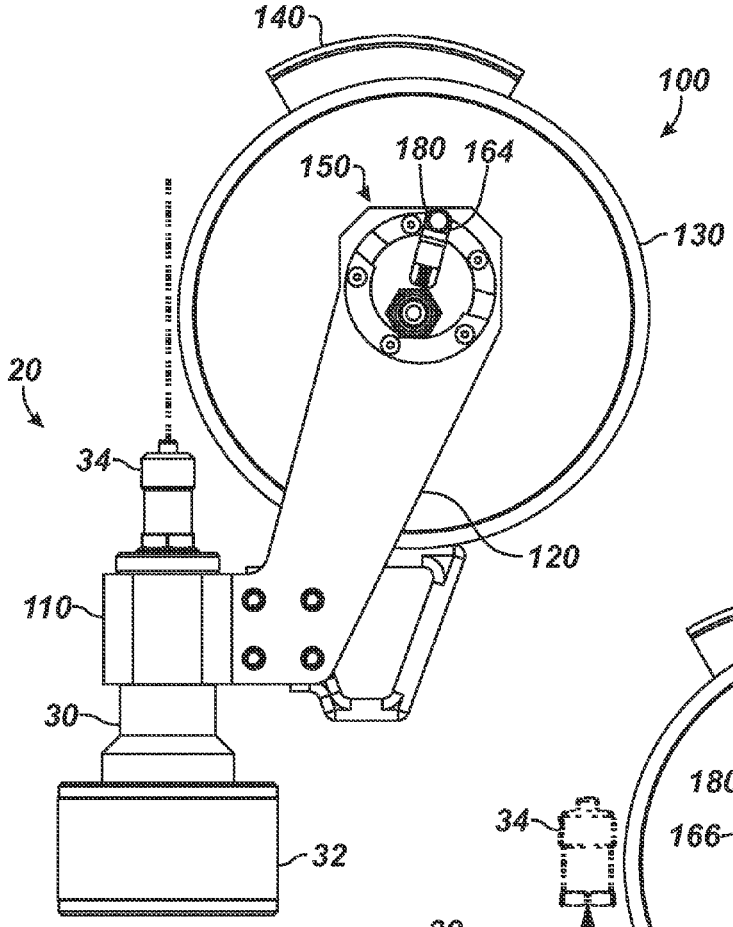
FIG. 6 is a side view of the stuffing box with the sheave in a position for fitting and removing a wireline from the sheave.

As shown in FIG. 6, however, rotating the hub assemblies 150-150' and fitting the key 180 in the second slot 164 on the outer housing 160 moves the sheave 130 away from the guard 140. This position provides clearance for rigging up the wireline 50 in the sheave's channel 132 without having to remove the guard 140, which can be time consuming.

Figure 7:
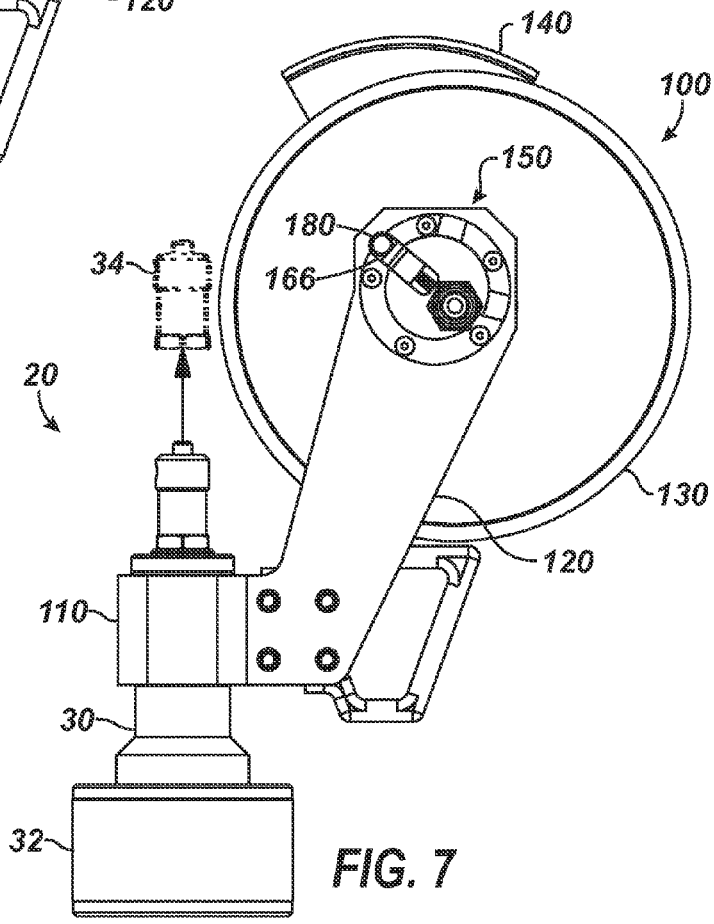
FIG. 7 is a side view of the stuffing box with the sheave in another position for fitting and removing a removable cartridge on the stuffing box.

Finally, as shown in FIG. 7, rotating the hub assemblies 150-150' and fitting the key 180 in the third slot 166 on the outer housing 160 moves the sheave 130 further away from the guard 140 and the stuffing box 20. With the sheave 130 in this position, an operator can access the hydraulic packing nut and remove and install the cartridge 32 for the stuffing box 20 and perform other maintenance. At any point, the operator can rotate the hub assemblies 150-150' and fit the key 180 in the first slot 162 to return the sheave to the operating condition.

As indicated above, adjusting the location of the axle's axis 173 adjusts how the periphery of the sheave 130 aligns with the centerline through the stuffing box 20. This adjustment can move the sheave 130 from the guard 140 for rigging up the wireline and can permit access to portion of the stuffing box 20. In addition to these adjustments, adjusting the location of the axle's axis 173 can shift the sheave 130 to other positions that permit different sizes of wireline 50 to run between the sheave 130 and the stuffing box 20. For example, although only three positions for the sheave 120 are shown in FIGS. 3A, 6 and 7, additional locations (i.e., slots) can be provided in which to lock the hubs 170 and position the sheave 130. These additional locations can provide pre-arranged center distances between the sheave 130 and the stuffing box 20 and can be used accommodate different sizes of wireline 50 without needing different sized sheaves and channel depths to match the wire sizes. It should be noted that the position of the guard 140 can be adjusted on the portion 122 of the frame 120 using a locking stud or the like to accommodate the adjustment of the sheave 130.

Figure 8A:
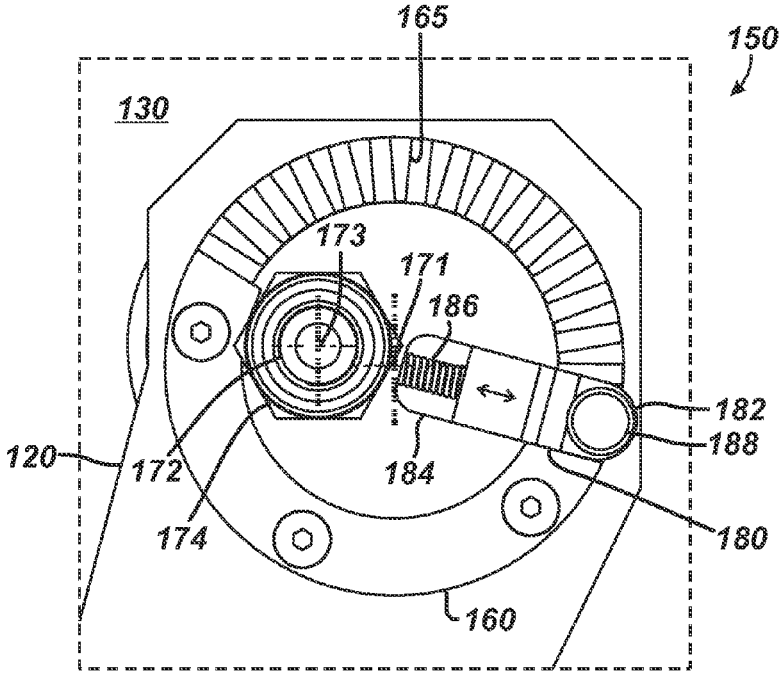
FIGS. 8A-8B show another hub assembly having multiple adjustment positions.
Figure 8B:
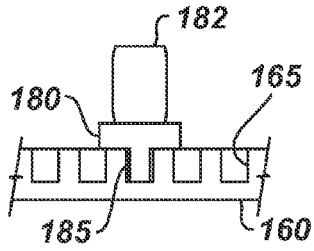

As shown in FIGS. 8A-8B, for example, the outer housing 160 of the hub assembly 150 can define a number of more finely spaced slots 165 for engaging portion of the key 180 so that the relative positions of the sheave 130 can be more finely defined. As shown in FIG. 8B, the key 180 can have a tooth 185 on its underside that fits into the finely spaced slots 165 of the housing 160. The opposing hub assembly 150' on the other side of the frame can be similarly configured.

Using this assembly 100 in FIGS. 8A-8B can be similar to that described above, but with an increased amount of adjustment positions available in which the key 180 can engage and lock the assembly 100. For example, an operator pushes the handle 188 on the key 180 and shifts the distal end 182 of the key 180 inward against the bias of the spring 186. The tooth 185 on the key 180 disengages from one of the slots 165, and the operator rotates the hub 170 in the housing 160 using the handle 188, thereby eccentrically shifting the center axis 173 of the axle 172 about the hub's center of rotation 171. The operator can then release the distal end 182 of the key 180 and allow its tooth 185 to engage another of the slots 165 to set the new position of the sheave 130. This new position can give a different alignment between the sheave's groove (132) with the centerline of the stuffing box (20) that can accommodate a different sized wireline (50).

Figure 9A:
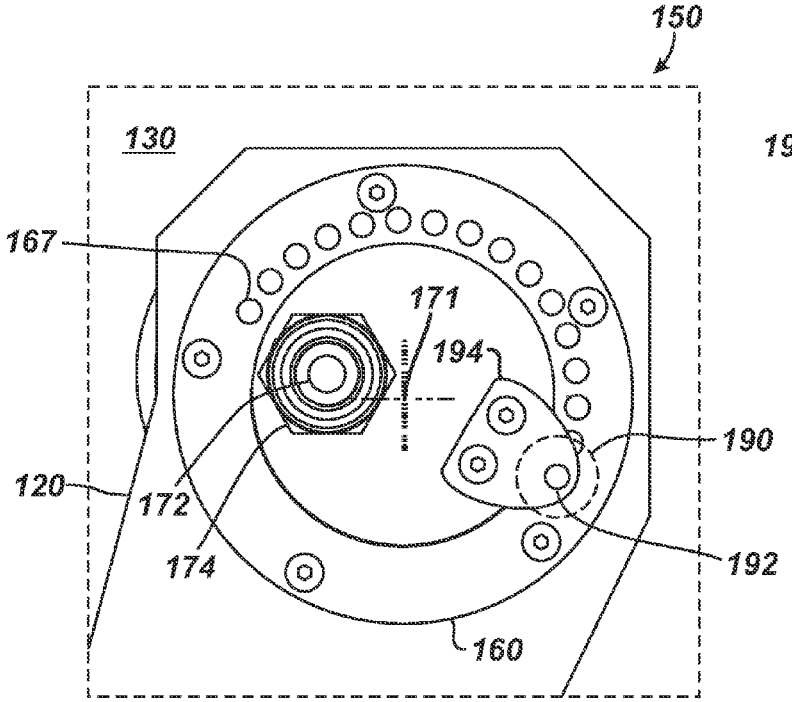
FIGS. 9A-9B show an alternative hub assembly having multiple adjustment positions.
Figure 9B:
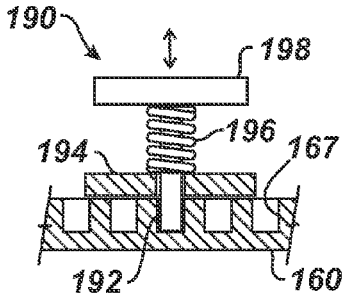

Rather than using the key 180 that moves perpendicular to the hub's axis 171 as disclosed previously, other movable mechanisms can be used to lock the hub assemblies 150-150' in various rotated positions. For example, in FIGS. 9A-9B, a key 190 has a stem 192 movable on a plate 194 and biased by a spring 196. The plate 194 is attached to the hub 170, and the stem 192 is movably affixed to the plate 194 by the spring 196. Using a handle 198 on the stem 192, an operator can pull the stem 192 out of a hole 167 against the bias of the spring 196 to unlock the hub 170 from the housing 160. The handle 198 can then be used to turn the hub 170 in the housing 160 so that the stem 192 aligns with another hole 167. At this point, the stem 192 can be released to engage the hole 167 and lock the hub 170 in position. Here, the key 190 moves in a direction parallel to the hub's axis 171 to engage and disengage from the lock locations of the holes 167. Again, this arrangement can be used to more finely adjust the position of the sheave 130 relative to the stuffing box (20) and guard (140).

The foregoing description of preferred and other embodiments is not intended to limit or restrict the scope or applicability of the inventive concepts conceived of by the Applicants. For example, although the number of lock locations are shown only partially around the housing in the Figures, it will be appreciated that lock locations can be positioned entirely around the housing or any suitable portion thereof. In addition, although the disclosed adjustable sheave assembly has been shown for use with a stuffing box on a wellhead, it will be appreciated that the disclosed assembly can be used for other implementations in which wireline is used. For example, the disclosed assembly can be used on a grease injection head or the like.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An adjustable wireline sheave assembly, comprising:

a frame defining a plurality of lock locations;

a hub disposed in the frame and being rotatable therein about a first axis of rotation;

an axle connected to the hub and defining a second axis of rotation eccentric to the first axis of rotation;

a sheave for running a wireline, the sheave disposed on the axle and being rotatable about the second axis of rotation; and a lock attached to the hub and having a movable key, the movable key having a first end connected to the hub and having a second end connected to the first end, the second end movable relative to the first end and being selectively movable to locked and unlocked conditions, the second end in the locked condition being engagable with one of the lock locations to fix the second axis of rotation of the axle relative to the first axis of rotation of the hub, the second end in the unlocked condition being disengageable from the lock locations, the movable key being usable to adjust the second axis of rotation of the axle relative to the first axis of rotation of the hub.

2. The assembly of claim 1, wherein the frame comprises first and second frame members disposed adjacent one another, and wherein the hub comprises first and second hub members each rotatably disposed on one of the frame members, the axle interconnecting the first and second hub members and supporting the sheave between the first and second frame members.

3. The assembly of claim 1, wherein the frame comprises a housing affixed to the frame, the housing holding the hub rotatably therein and defining the lock locations.

4. The assembly of claim 3, wherein the housing defines slots for the lock locations.

5. The assembly of claim 1, wherein the second end is movable between the locked and unlocked conditions in a direction perpendicular to the first axis of rotation.

6. The assembly of claim 1, wherein the second end is movable between the locked and unlocked conditions in a direction parallel to the first axis of rotation.

7. The assembly of claim 1, wherein the lock comprises a spring biasing the second end toward the locked condition.

8. The assembly of claim 1, wherein the movable key comprises a handle disposed on the second end, the second end movable from the locked condition to the unlocked condition by the handle, the hub being rotatable by the handle in the unlocked condition.

9. The assembly of claim 1, wherein the frame is connectable to a stuffing box of a wellhead, and wherein the adjustment of the second axis of rotation of the axle adjusts alignment of a periphery of the sheave to the stuffing box.

10. The assembly of claim 9, wherein the adjustment of the alignment of the periphery of the sheave to the stuffing box permits different sizes of wireline to run between the sheave and the stuffing box.

11. The assembly of claim 9, wherein the adjustment of the alignment of the periphery of the sheave to the stuffing box permits access to portion of the stuffing box.

12. The assembly of claim 1, wherein the frame has a guard connected thereto, the guard covering at least a portion of a periphery of the sheave, and wherein the adjustment of the second axis of rotation of the axle adjusts a distance between the guard and the periphery of the sheave.

13. The assembly of claim 1, further comprising a stuffing box body connectable to a wellhead and having a passage for running wireline therethrough, wherein the frame is connected to the stuffing box body.

14. A stuffing box, comprising:

a body connectable to a wellhead and having a passage for running wireline therethrough;

a frame connected to the body and defining a plurality of lock locations;

a hub disposed in the frame and being rotatable therein about a first axis of rotation;

an axle connected to the hub and defining a second axis of rotation eccentric to the first axis of rotation;

a sheave for running a wireline, the sheave disposed on the axle and being rotatable about the second axis of rotation; and a lock attached to the hub and having a movable key, the movable key having a first end connected to the hub and having a second end connected to the first end, the second end movable relative to the first end and being selectively movable to locked and unlocked conditions, the second end in the locked condition being engagable with one of the lock locations to fix the second axis of rotation of the axle relative to the first axis of rotation of the hub, the second end in the unlocked condition being disengageable from the lock locations, the movable key being usable to adjust the second axis of rotation of the axle relative to the first axis of rotation of the hub.

15. An adjustable wireline sheave assembly, comprising:

a frame;

a hub disposed in the frame and being rotatable therein about a first axis of rotation;

an axle connected to the hub and defining a second axis of rotation eccentric to the first axis of rotation;

a sheave for running a wireline, the sheave disposed on the axle and being rotatable about the second axis of rotation;

means disposed on the hub for rotating the first axis of rotation of the axle relative to a second axis of rotation on the frame; and means movably disposed on the means for rotating for selectively locking orientation of the first axis of rotation relative to the second axis of rotation, the means for selectively locking comprising means for keying engagement and disengagement with the frame to adjust the first axis relative to the second axis.

16. The assembly of claim 15, wherein the means for selectively locking comprises means for locking the first axis of rotation of the axle at one of a plurality of orientations.

17. The assembly of claim 15, wherein the frame is connectable to a stuffing box of a wellhead, and wherein the means for selectively locking comprises means for adjusting alignment of a periphery of the sheave relative to the stuffing box.

18. The assembly of claim 17, wherein the means for selectively locking comprises means for permitting different sizes of wireline to run between the sheave and the stuffing box.

19. The assembly of claim 17, wherein the means for selectively locking comprises means for permitting access to portion of the stuffing box.

20. The assembly of claim 15, wherein the frame has a guard connected thereto, the guard covering at least a portion of a periphery of the sheave, and wherein the means for selectively locking comprises means for moving the sheave away from the guard.

21. An adjustable wireline sheave assembly, comprising:

a frame defining a plurality of lock locations, the frame comprising first and second frame members disposed adjacent one another;

a hub disposed in the frame and being rotatable therein about a first axis of rotation, the hub comprising first and second hub members each rotatably disposed on one of the frame members;

an axle interconnecting the first and second hub members and defining a second axis of rotation eccentric to the first axis of rotation;

a sheave for running a wireline, the sheave supported on the axle between the first and second frame members and being rotatable about the second axis of rotation; and a lock attached to the hub and being selectively movable to locked and unlocked conditions on the hub, the lock in the locked condition being engagable with one of the lock locations to fix the second axis of rotation of the axle relative to the first axis of rotation of the hub, the lock in the unlocked condition being disengageable from the lock locations and being usable to adjust the second axis of rotation of the axle relative to the first axis of rotation of the hub.

22. The assembly of claim 21, further comprising a stuffing box body connectable to a wellhead and having a passage for running wireline therethrough, wherein the frame is connected to the stuffing box body.

23. The assembly of claim 21, wherein the frame comprises a housing affixed to the frame, the housing holding the hub rotatably therein and defining the lock locations.

24. The assembly of claim 23, wherein the housing defines slots for the lock locations.

25. The assembly of claim 21, wherein the lock comprises a key having first and second ends, the first end connected to the hub, the second end connected to the first end and movable relative to the first end, the second end movable to the locked condition and engageable with one of the lock locations, the second end movable to the unlocked condition and disengageable from the lock locations.

26. The assembly of claim 25, wherein the second end is movable between the locked and unlocked conditions in a direction perpendicular to the first axis of rotation.

27. The assembly of claim 25, wherein the second end is movable between the locked and unlocked conditions in a direction parallel to the first axis of rotation.

28. The assembly of claim 25, wherein the lock comprises a spring biasing the second end toward the locked condition.

29. The assembly of claim 25, wherein the key comprises a handle disposed on the second end, the second end movable from the locked condition to the unlocked condition by the handle, the hub being rotatable by the handle in the unlocked condition.

30. The assembly of claim 21, wherein the frame is connectable to a stuffing box of a wellhead, and wherein the adjustment of the second axis of rotation of the axle adjusts alignment of a periphery of the sheave to the stuffing box.

31. The assembly of claim 30, wherein the adjustment of the alignment of the periphery of the sheave to the stuffing box permits different sizes of wireline to run between the sheave and the stuffing box.

32. The assembly of claim 30, wherein the adjustment of the alignment of the periphery of the sheave to the stuffing box permits access to portion of the stuffing box.

33. The assembly of claim 21, wherein the frame has a guard connected thereto, the guard covering at least a portion of a periphery of the sheave, and wherein the adjustment of the second axis of rotation of the axle adjusts a distance between the guard and the periphery of the sheave.

* * * * *